US005488904A

United States Patent [19]

Kleinschmidt et al.

[11] Patent Number: 5,488,904

[45] Date of Patent: Feb. 6, 1996

[54] DEVICE FOR PIVOTABLY ADJUSTING FLEXIBLE PRINTING PLATES ON THE PLATE CYLINDER OF A ROTARY PRINTING MACHINE

[75] Inventors: Uwe Kleinschmidt, Östringen; Hans-Jürgen Kusch, Neckargemünd; Rudi Stellberger, Kronau, all of Germany

[73] Assignee: Heidelberger Druckmaschinen Aktiengesellschaft, Heidelberg, Germany

[21] Appl. No.: 346,886

[22] Filed: Nov. 30, 1994

[30] Foreign Application Priority Data

Dec. 4, 1993 [DE] Germany ..... 9318599 U

[51] Int. Cl.[6] ..... B41F 27/12

[52] U.S. Cl. ..... 101/415.1

[58] Field of Search ..... 101/415.1, 378

[56] References Cited

U.S. PATENT DOCUMENTS 4,785,736 11/1988 Jeschke .
5,337,486 8/1994 Brechtel ..... 101/415.1

FOREIGN PATENT DOCUMENTS 1536954 2/1970 Germany ..... 101/415.1
3604209 8/1987 Germany .

*Primary Examiner*—J. Reed Fisher
*Attorney, Agent, or Firm*—Nils H. Ljungman & Associates

[57] ABSTRACT

A device for pivoting flexible printing plates on the plate cylinder of a rotary printing machine comprises clamping rails for mounting and clamping the two plate ends, articulated levers pivot-mounted on the cylinder body and articulatingly connected to the clamping rails so that both clamping rails are adjustable relative to each other such that the printing plate may be cocked on the plate cylinder.

20 Claims, 4 Drawing Sheets

DEVICE FOR PIVOTABLY ADJUSTING FLEXIBLE PRINTING PLATES ON THE PLATE CYLINDER OF A ROTARY PRINTING MACHINE

BACKGROUND OF THE INVENTION

1. Field of the Invention

The invention generally relates to a printing press having a device for correcting the register of a flexible printing plate on a plate cylinder. More specifically, the present invention relates to a device for pivoting flexible printing plates on a plate cylinder of a rotary printing machine. In essence, a device for pivoting a printing plate can have clamping/tensioning bars for mounting and clamping both plate ends of the printing plate, articulated levers pivot-mounted on the cylinder body and articulatingly connected to the clamping bars so that both clamping bars are adjustable with respect to each other, and control apparatus for turning, or pivoting, the printing plate on the plate cylinder in order to correct the register.

2. Background Information

One type of known device of the type described above is disclosed by German Patent Application No. 36 04 209 A1, which corresponds to U.S. Pat. No. 4,785,736. With the disclosed device, it is possible to cock the printing plate on the plate cylinder in order to correct the register. In general, the registers which are often corrected in printing presses include: "circumferential"—up and down on a printed page; "lateral"—side to side on a printed page; and "diagonal"—moving the top and bottom in opposite lateral directions. In general, such register corrections are necessary with multi-color printing machines, wherein each color is typically applied by a different plate, and as such, the plates essentially all need to be aligned with as much precision as possible to produce the highest possible quality printed image. Thus, such a machine can make it possible to compensate for photocopying errors, mounting errors and other types of errors which might cause the printed image to turn on the printing plate. Such a device can essentially simultaneously effect a circumferential/lateral correction of the printed image with respect to the reproduction of the printed image. However, the known embodiment provides a complicated construction which, in particular, when using small sheet-fed printing machines, leads to an increase in price, which is not appropriate.

OBJECT OF THE INVENTION

Proceeding from the above discussed device, it is the object of the present invention to provide an inexpensive solution for cocking the printing plate and permitting exact register corrections.

SUMMARY OF THE INVENTION

According to the present invention, this object can be achieved by providing a correction device which, in the direction of rotation of the plate cylinder, has a control device that preferably acts on the front ends of a trailing clamping bar and displaces the trailing clamping bar in an axial direction of the plate cylinder. In addition, on one side of the plate cylinder there can preferably be an articulated lever having a ball-shaped end which extends into a slit formed in the trailing clamping bar. This articulated lever, with respect to a trunnion on the cylinder body, can preferably be connected to a hinge pin on the leading clamping bar. Further, on the other side of the plate cylinder, that is, the side opposite the articulated lever, a coupling element can preferably be provided between a trunnion on the cylinder body and a hinge pin on the leading clamping bar. The hinge pins of the leading clamping bar can preferably be offset inwards with respect to the trunnions on the plate cylinder, in other words, offset towards one another in relation to the position of the trunnions.

Such a device as briefly outlined above, can essentially make it possible to cock the leading clamping bar, by the amount to be corrected, by axially displacing the trailing clamping bar. Once such a correction of the register is performed, a new printing plate may then be mounted by clamping a leading edge in the leading clamping bar, laying the plate about the plate cylinder by rotating the cooperating blanket cylinder so that the trailing plate end is brought adjacent the trailing clamping bar, inserted the trailing end of the plate into the trailing clamping bar, and clamping tightly. Thereafter, the printing plate can be tensioned on the plate cylinder.

Alternatively, when a register correction is needed for a printing plate that is already mounted and clamped on the plate cylinder, the printing plate would typically need to be loosened somewhat in order to be pivoted on the plate cylinder. Then, after the correction is made, the clamps can be retightened.

In one advantageous embodiment of the present invention, the clamping bar for the trailing plate end can be held against the bottom of the cylinder gap by means of abutments within the cylinder gap. Such abutments can preferably be configured for permitting free displacement of the clamping bar essentially axially and/or circumferentially within the cylinder gap. Thus, it is possible to cock a clamping bar, pre-tensioned by means of springs in the circumferential direction, by the amount which is predetermined by the printing plate when being mounted on the plate cylinder.

A further embodiment of the present invention provides that the control apparatus for pivoting the clamping bars can preferably be designed as an eccentric positioning device, i.e., a threaded bolt with an eccentric bushing therearound. This eccentric device can preferably be mounted on the front end of the plate cylinder, that is, the end of the cylinder which is readily accessible to the operator. This makes it possible for the press operator to easily input the amount for the cocking correction, thus providing an exact adjustment of the register with very little efforts.

A further discussion of the embodiments of the present invention will be presented herebelow with reference to the figures. It should be understood that when the word "invention" is used in this application, the word "invention" includes "inventions", that is, the plural of "invention". By stating "invention", Applicant does not in any way admit that the present application does not include more than one patentably and non-obviously distinct invention, and maintains the possibility that this application may include more than one patentably and non-obviously distinct invention. The Applicant hereby asserts that the disclosure of this application may include more than one invention, and, in the event that there is more than one invention, that these inventions may be patentable and non-obvious, one with respect to the other.

One aspect of the invention reside broadly in a device for adjusting positioning of a printing plate mounted on a plate cylinder of a rotary printing machine, the printing plate having a first end and a second end, the adjustment device comprising: first rail apparatus for clamping the first end of a printing plate to the plate cylinder; second rail apparatus for clamping the second end of a printing plate to the plate cylinder, the second rail apparatus being disposed substantially parallel to the first rail apparatus; adjusting apparatus for selectively adjustably displacing the first rail apparatus in an axial direction with respect to the plate cylinder; and apparatus for substantially simultaneously displacing the second rail apparatus in at least an axial direction upon the axial displacement of the first rail apparatus.

Another aspect of the invention resides broadly in a device for adjusting positioning of a printing plate mounted on a plate cylinder of a rotary printing machine, the printing plate having a first end and a second end, the adjustment device comprising: first rail apparatus for clamping the first end of a printing plate to the plate cylinder; second rail apparatus for clamping the second end of a printing plate to the plate cylinder, the second rail apparatus being disposed substantially parallel to the first rail apparatus; adjusting apparatus for selectively adjustably displacing the first rail apparatus with respect to the plate cylinder; and apparatus for substantially simultaneously displacing the second rail apparatus in at least an axial direction upon the displacement of the first rail apparatus, the apparatus for substantially simultaneously displacing comprising a pivotable member for being pivotably mounted to the plate cylinder; the pivotable member comprising: a first portion for engaging with the first rail apparatus; a second portion for engaging with the second rail apparatus; and a pivot disposed between the first and second portions, the pivotable member being pivotable about the pivot; the first rail apparatus comprises a slot; the first portion of the pivotable member comprises a portion disposed within the slot for moving the pivotable member with the slot upon movement of the first rail apparatus; and the second portion of the pivotable member comprises apparatus for engaging the second rail apparatus for moving the second rail apparatus upon movement of the first rail apparatus.

Still another aspect of the invention resides broadly in a plate cylinder for a printing press, the plate cylinder comprising: a first axial end and a second axial end, the second axial end being spaced axially from the first axial end; an axial groove disposed between the first axial end and the second axial end; apparatus for adjustably positioning a printing plate about the plate cylinder, the printing plate having a first end and a second end, the apparatus for adjustably positioning being disposed in the axial groove, and the apparatus for adjustably positioning comprising: first rail apparatus disposed within the axial groove for clamping the first end of a printing plate to the plate cylinder; second rail apparatus for clamping the second end of a printing plate to the plate cylinder, the second rail apparatus being disposed substantially parallel to the first rail apparatus, the second rail apparatus having a first axial end adjacent the first axial end of the cylinder, and a second axial end adjacent the second axial end of the cylinder; adjusting apparatus for selectively adjustably displacing the first rail apparatus with respect to the plate cylinder; apparatus for substantially simultaneously displacing the second rail apparatus upon the displacement of the first rail apparatus, the apparatus for substantially simultaneously displacing comprising a pivotable member pivotably mounted in the groove of the plate cylinder adjacent the first axial end of the plate cylinder for guiding movement of the first axial end of the second rail apparatus; the pivotable member comprising a first portion, a second portion, and a first pivot disposed between the first and second portions, the first pivot for pivotably mounting the pivoting member in the groove; the first portion comprising apparatus for engaging the first rail apparatus; the second portion comprising a first hinge pin for engaging the second rail apparatus; the second rail apparatus comprising a portion for engaging the first hinge pin; a coupling element pivotably mounted adjacent the second axial end of the plate cylinder for guiding movement of the second end of the second rail apparatus, the coupling element comprising: a first end and a second end; the first end of the coupling element comprises a second pivot, the second pivot for pivotably mounting the coupling element in the groove; the second end of the coupling element being pivotable about the second pivot; the second end of the coupling element comprises a second hinge pin; the second rail apparatus comprising a portion for engaging the second hinge pin; and the first and second hinge pins are disposed axially offset towards one another with respect to their corresponding one of the first and second pivots.

BRIEF DESCRIPTION OF THE DRAWINGS

Specimen embodiments of the present invention are schematically illustrated in the accompanying drawings, in which.

DESCRIPTION OF THE PREFERRED EMBODIMENTS

Figure 1:
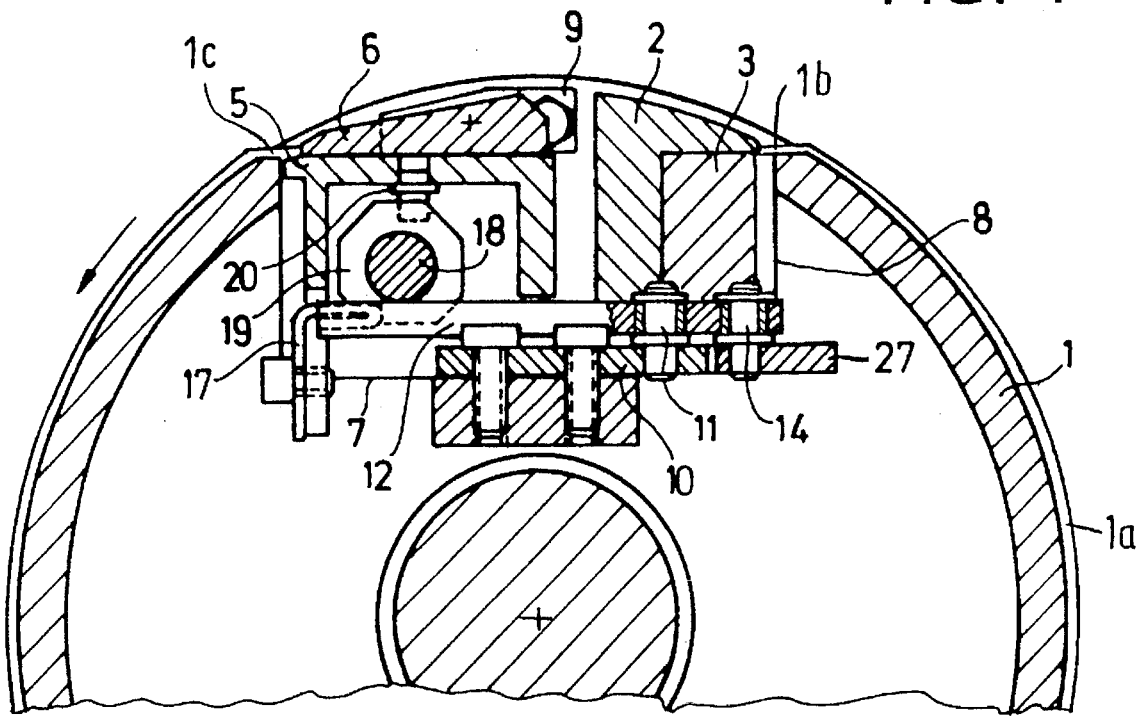
FIG. 1 shows a fragmentary cross-sectional view of a plate cylinder according to line I—I in FIG. 3.
Figure 2:
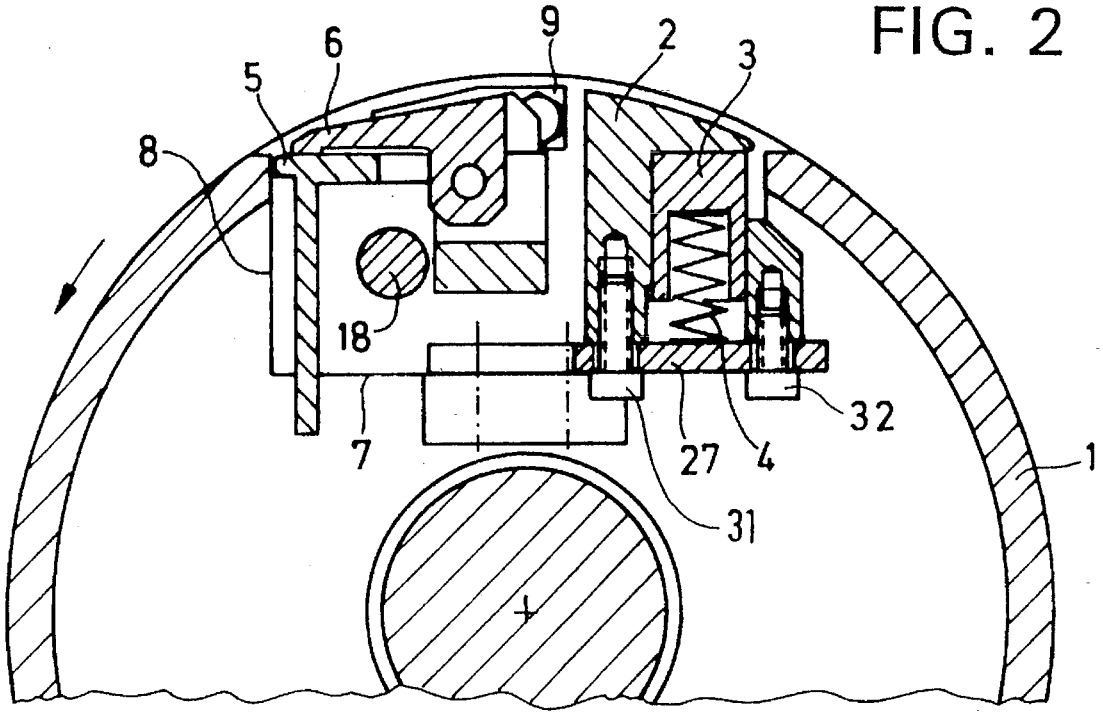
FIG. 2 shows a fragmentary cross-sectional view of the plate cylinder according to line II—II in FIG. 3.
Figure 1A:
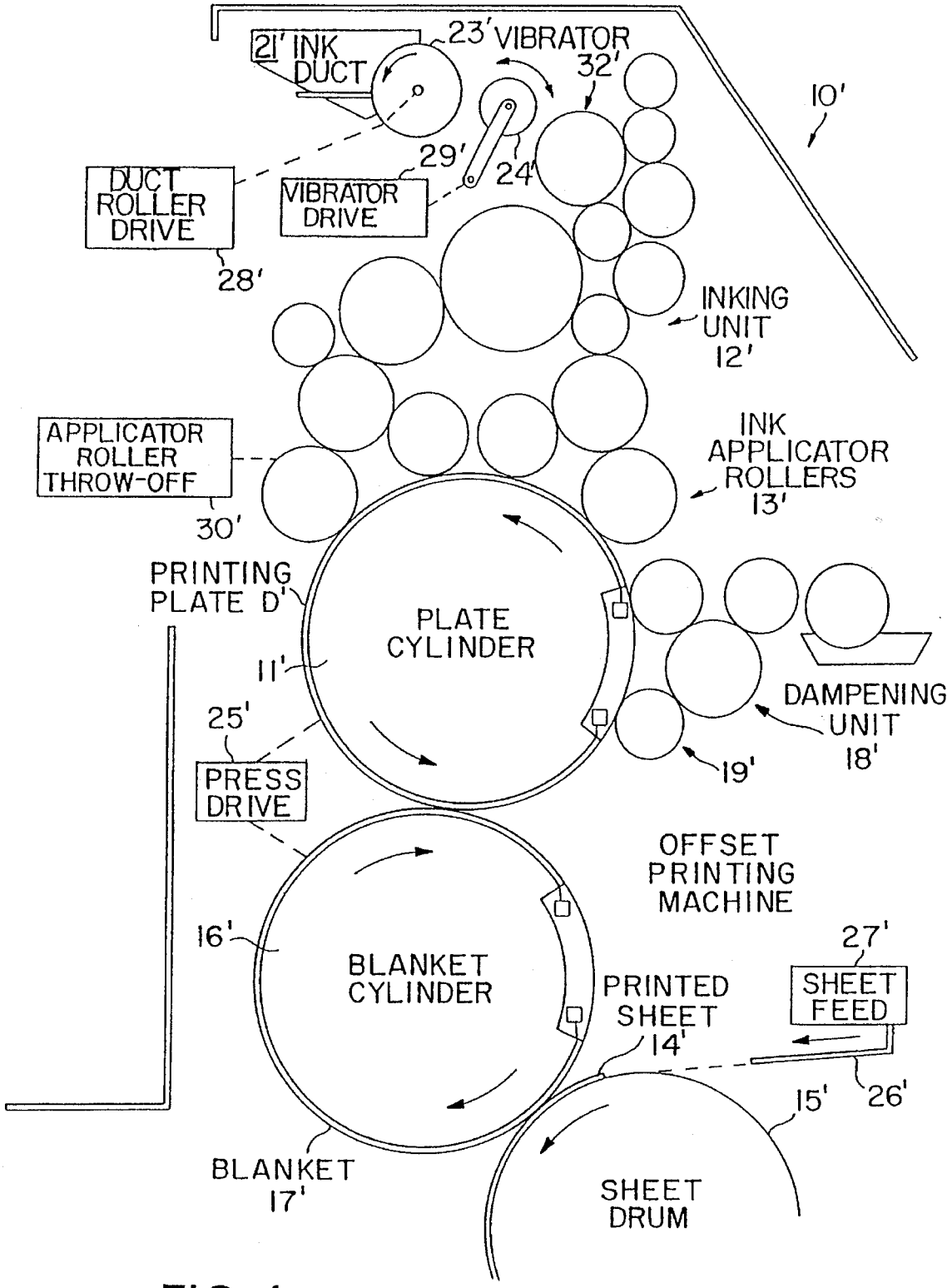
FIG. 1*a* is a diagrammatic side elevational view of a printing unit of a printing press in which the adjustment device of FIGS. 1–3*a* could be incorporated.

FIG. 1*a* illustrates a rotary print stand 10' of a rotary printing press. It should be generally understood that the components as briefly outlined herebelow with respect to the rotary print stand 10' are well-known, and therefore not discussed in any significant detail herein. The rotary print stand 10' can employ a register correction device in accordance with the present invention. A rotary print stand 10' can generally include: a plate cylinder 11' for having mounted thereon a printing plate D'; an inking unit 12' which includes ink applicator rollers 13' for applying ink to the printing plate; a dampening (or wetting) unit 18' having dampening applicator rollers 19' for transferring a dampening agent to the printing plate, a blanket cylinder 16' carrying a rubber blanket 17' for receiving an ink impression from the printing plate, and a sheet drum 15' for carrying a printed sheet 14' onto which the ink impression carried by blanket 17' is transferred. A duct roller 23' is typically mounted adjacent to an ink duct 21'. Typically, ink is transferred from duct roller 23' to inking unit 12' by means of a vibrator roller 24', which vibration roller oscillates to successively pick up ink from duct roller 23' and deposit the same on a roller 32' of inking unit 10'.

Typically, the printing stand 10' will also include auxiliary mechanisms such as, for example, a duct roller drive 28', a vibrator roller drive 29', an applicator roller throw-off 30' for lifting the ink applicator rollers 13' off of the printing plate, a press drive 25' and a sheet feed 27' for supplying the sheets to be printed 26' to sheet drum 15'.

It should be understood that the components discussed above with relation to FIG. 1*a* may, if appropriate, essentially be considered to be interchangeable with similar components discussed further herebelow with relation to FIGS. 1–3*a*.

For the remainder of the description, FIGS. 1, 2, 3 and 3*a* are essentially discussed together, and reference made to a component depicted in one of the figures can also apply to the other figures.

As shown in FIGS. 1, a printing plate la may be mounted on the outer cylindrical surface of a plate cylinder 1. The plate cylinder 1 can preferably be configured to have an axial groove 8. A leading end 1*b* of the printing plate la may be clamped in a leading clamping bar, or tensioning rail 2 disposed within groove 8. A second clamping bar 3, which can be closed under the force of compression springs 4 can preferably be used to clamp and fix the plate end 1*a*. A trailing plate end 1*c* can preferably be clamped between a trailing clamping bar, or tensioning rail 5 and a clamping plate 6. The trailing plate end 1*c* can preferably be mounted on the plate cylinder 1 by displacing the clamping rail 5 and the clamping plate 6 in a clamping direction of the printing plate 1. To allow for such a movement of the clamping rail 5, abutments 9 can be provided within the cylinder groove 8. These abutments 9 can preferably be configured for holding the front ends (in the direction of rotation of the cylinder 1) of the tensioning rail 5 on the bottom 7 of the cylinder groove 8 while enabling the tensioning rail 5 to be freely displaceable, that is, in an axial, or circumferential direction of the plate cylinder 1.

In the cylinder groove 8, bearing plates 10 can preferably be fixed on both sides of the plate cylinder 1. The bearing plates 10 can each preferably be configured to receive a trunnion 11. On one side of the plate cylinder 1, an articulated lever 12 can preferably be pivot-mounted on the trunnion 11. On the other side of the plate cylinder 1, a coupling element 13 (shown in FIGS. 3 and 3*a*) can preferably be pivot-mounted on the trunnion 11. Preferably, both the articulated lever 12 and the coupling element 13 can be connected to the tensioning rail 2 via hinge pins 14. The hinge pins 14, on the leading tensioning rail 2, can preferably be offset inwards, in an axial direction, with respect to the trunnions 11 on the plate cylinder 1. In other words, the hinge pins 14 can preferably be offset towards one another in relation to the trunnions 11. This offset can essentially be indicated by angle (alpha) shown in FIG. 3*a*. In accordance with at least one possible embodiment of the present invention, the angle (alpha) can preferably be between about 44 degrees to about 50 degrees with respect to a circumferential direction preferably defined through the trunnions 11. This offset of the hinge pins 14 can essentially permit a cocking of the leading tensioning rail 2 when the articulated lever 12 is actuated, as will be discussed further herebelow.

In the area of the trailing tensioning rail 5, the articulated lever 12 can preferably be provided with a ball-shaped end 15. This ball-shaped end 15 can preferably extend into a slit 16 of the trailing tensioning rail 5. The slit 16 can preferably be formed in an adjusting body 17, which adjusting body 17 can be fastened to the tensioning rail 5 by a fastening device, such as by means of bolts, or screws.

Figure 3:
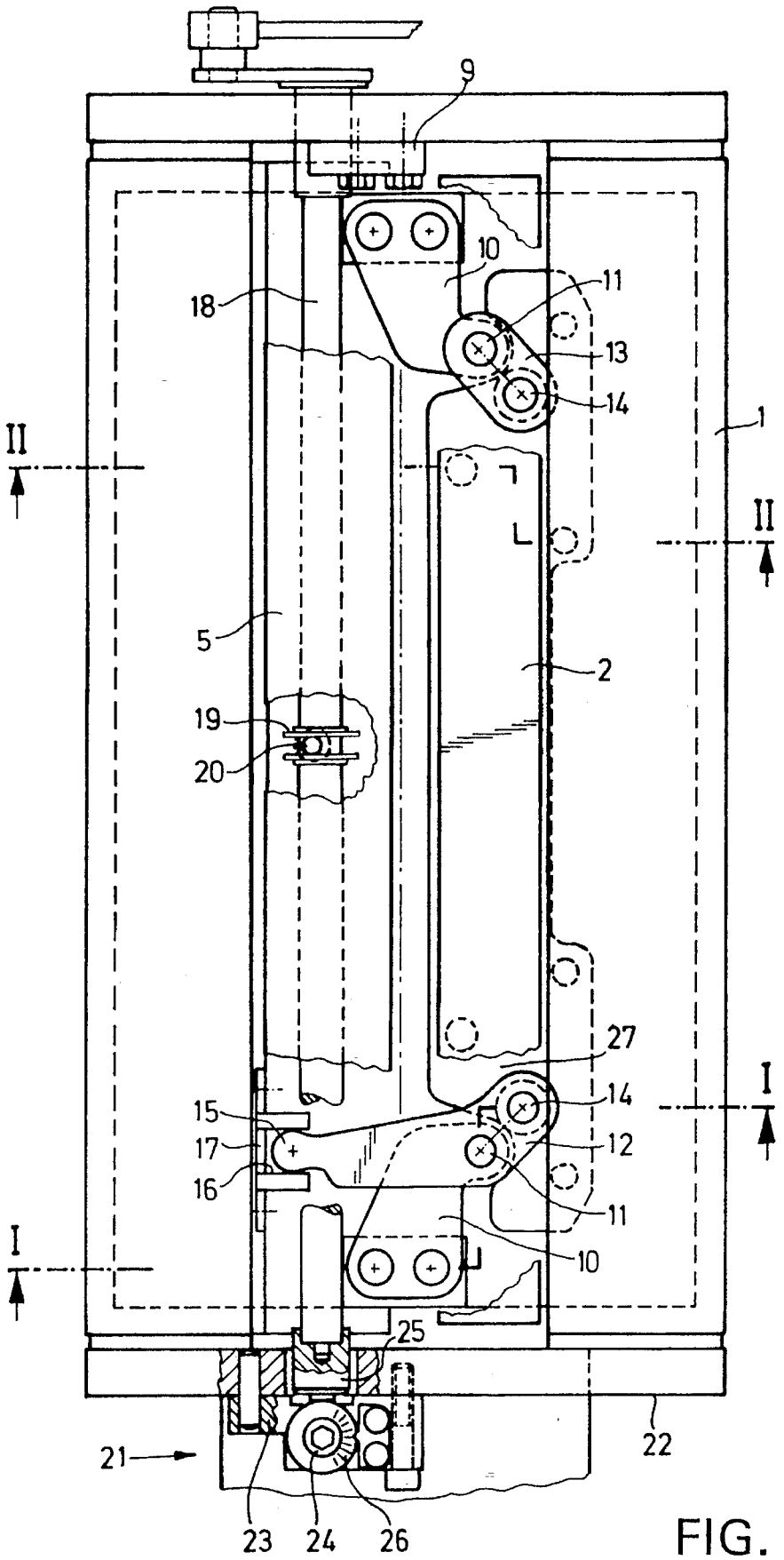
FIG. 3 shows a top view of the plate cylinder having clamping bars and an adjusting device for adjusting the clamping bars.
Figure 3A:
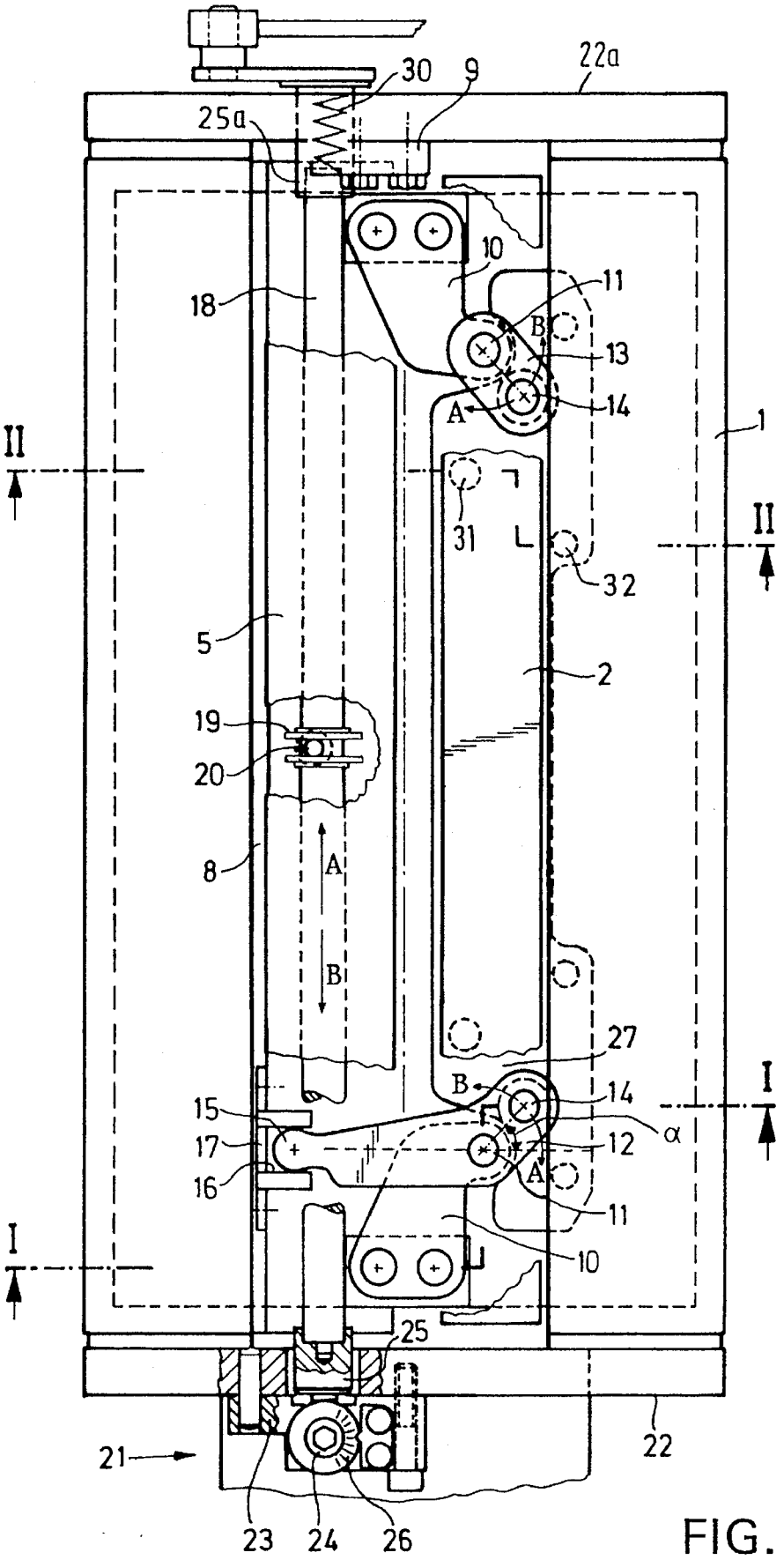
FIG. 3*a* shows another depiction of a top view of the plate cylinder of FIG. 3 with addition components illustrated.

An adjusting spindle 18 can preferably be provided within the cylinder groove 8. As shown in FIG. 3*a*, the adjusting spindle 18 can preferably be mounted, by means of bearings 25 and 25*a* respectively, to the end sides 22 and 22*a*, respectively, of the plate cylinder 1. A slit body 19 can preferably be attached to the adjusting spindle 18. This slit body 19 can preferably be connected to the tensioning rail 5 via an adjusting bolt 20. Thus, the tensioning rail 5 may be axially adjusted by axially displacing the adjusting spindle 18. This adjusting motion produced by displacing the spindle 18, can be communicated to the tensioning rail 2 via the articulated lever 12, which articulated lever 12 pivots during an axial movement of the tensioning rail 5.

A control device 21 can preferably be fastened to the front end side 22 of the plate cylinder 1. This control device 21 can preferably be formed by a holder 23 mounted to the end side 22 of the plate cylinder 1. This holder 23 can preferably receive an eccentric adjusting knob 24, wherein the eccentricity is shown somewhat exaggerated in FIG. 3*a*. The adjusting knob 24 can preferably be configured to act directly on the bearing body 25 to axially displace the adjusting spindle 18 via the bearing body 25. The adjusting spindle 18 can preferably be biased, along with the bearing 25, into engagement with the eccentric adjusting knob 24. To provide such a biasing action, a biasing device, such as spring 30 (shown in FIG. 3*a*), could be provided adjacent the bearing 25*a*, on the opposite side 22*a* of the plate cylinder 1. The amount by which the eccentric adjusting device 24 is turned may be read from a dial 26 provided essentially directly on the eccentric adjusting device 24.

A basic operation of the above-discussed adjustment apparatus follows in relation to FIG. 3*a*. Upon determination that a register adjustment is needed, the press operator can turn the eccentric adjustment device 24 by a certain amount. In a first direction of turning of the adjustment device 24, the adjustment device 24 can push the adjusting spindle 18 in a first axial direction as indicated by arrow (A). In the opposite direction of turning of the adjustment device 24, a camming surface of the adjustment device 24 would essentially move away from the bearing member 25, and allow biasing member 30 to push the adjusting spindle 18 in an opposite axial direction as indicated by arrow (B).

Since the adjusting spindle 18 is preferably coupled to the tensioning rail 5 via the coupling 19, 20, the tensioning rail 5 will move axially in the same direction (A, B) as the adjusting spindle 18 is moved. In so doing, a pivoting motion can be communicated to the articulated lever 12. The pivoting motion of the lever 12 will tend to move the tensioning rail 2, preferably via the hinge pins 14, in a generally opposite axial direction (B, A) from which the tensioning rail 5 is moving. Further, because of the special arrangement of the trunnions 11, in view of the hinge pins 14, the hinge pins 14 will also preferably pivot about the trunnions 11 in a corresponding pivot direction (A or B), corresponding to the direction (A or B) in which the adjusting spindle 18 is being moved.

Therefore, in addition to moving in a generally axial direction, the tensioning rail 2 (with the bearing plate 27) will also be cocked with respect to the longitudinal axis of the plate cylinder 1, according to the cocked position necessary to correct the register of the printing plate 1*a*. In the depicted embodiment, the tensioning rail 2 can preferably be fastened onto the bearing plate 27 by means of screws 31 and 32. The bearing plate 27 can be respectively hinged to the articulated lever 12, and coupling 13, via the hinge pin 14.

Since the printing plate 1a is typically made of a rigid material, the cocking of the tensioning rail 2, which follows from the axial displacement of rail 5, essentially results in a corresponding cocking of the tensioning rail 5. As such, after mounting and clamping the leading end 1*b* of the printing plate 1*a* in the tensioning rail 2, and guiding the printing plate 1*a* around the plate cylinder 1, a correct fastening of the trailing end 1*c* of the printing plate 1*a* in the trailing tensioning rail 5, automatically moves the tensioning rail 5 into a respective cocking position with respect to the leading tensioning rail 2.

One feature of the invention resides broadly in a device for pivoting flexible printing plates on the plate cylinder of a rotary printing machine, comprising clamping rails for mounting and clamping the two plate ends, articulated levers pivot-mounted on the cylinder body and articulatingly connected to the clamping rails, so that both clamping rails can be adjusted relative to each other, and comprising control means for turning the printing plate on the plate cylinder for the purpose of correcting the register, characterized in that, seen in direction of rotation of the plate cylinder 1, the control means 21 acts on the front ends of a trailing clamping rail 5 and displaces the clamping rail in axial direction of the plate cylinder 1, that, on one side of the plate cylinder 1, an articulated lever 12 having a ball-shaped end 15 extends into a slit 16 formed in the trailing clamping rail 5, that with respect to a trunnion 11 provided on the cylinder body the articulated lever 12 is connected to a hinge pin 14 provided on a leading clamping rail 2, that, on the other side of the plate cylinder 1, there is provided a coupling element 13 between a trunnion 11 provided on the cylinder body 1 and the hinge pin 14 provided on the leading clamping rail 2, and that the hinge pins 14 are offset inwards with respect to the trunnions 11 on the plate cylinder 1.

Another feature of the invention resides broadly in the device characterized in that the front ends of the clamping rail 5 for the trailing plate end are held on the bottom 7 of the cylinder gap 8 by abutments 9, the abutments permitting free displacement of the clamping rail 5.

Yet another feature of the invention resides broadly in the device characterized in that the control means 21 is designed as an adjusting eccentric 24 and mounted on the front end 22 of the plate cylinder 1.

Some examples of clamping arrangements and register adjustment apparatus which could possibly be adapted for use in the present invention, along with additional components generally associated with clamping mechanisms and register adjustment apparatus which might be interchangeable with, or adaptable as components of the embodiments as described hereinabove, might be disclosed by the following U.S. Patents, all of which are assigned to Heidelberger Drückmaschinen Aktiengesellschaft, the assignee for the present invention: U.S. Pat. No. 4,831,931 to Jeschke and Stadler, entitled "Device for Tensioning a Flexible Printing Plate on a Plate Cylinder of a Rotary Printing Machine"; U.S. Pat. No. 5,014,619 to Jeschke, entitled "Device for Tensioning a Flexible Printing Plate on a Plate Cylinder of a Rotary Printing Machine"; and U.S. Pat. No. 5,088,409 to Roskosch, entitled "Device for Adjusting a Flexible Printing Plate on a Plate Cylinder of A Rotary Printing Press".

Some additional examples of accessories which could possibly be used in the context of the present invention might be disclosed by the following U.S. Pat. No. 5,056,430 to Bayerlein and Leuerer, entitled "Method of Positioning Plate Cylinders in a Multi-Color Rotary Printing Press"; U.S. Pat. No. 4,980,718 to Salter et al., entitled "Registration Method in Photolithography and Equipment for Carrying Out This Method"; and U.S. Pat. No. 4,694,749 to Takeuchi, entitled "Method of Presetting Plate Cylinders for Registering an Offset Printing Press".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. G 93 18 599.5, filed on Dec. 4, 1993, having inventors Uwe Kleinschmidt, Hans-Jürgen Kusch and Rudi Stellberger, and DE-OS G 93 18 599.5 and DE-PS G 93 18 599.5, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A device for adjusting positioning of a printing plate mounted on a plate cylinder of a rotary printing machine, the plate cylinder having a first axial end, and a second axial end disposed opposite to said first axial end, the plate cylinder defining an axial dimension between the first and second axial ends thereof, and the plate cylinder having a groove disposed axially between the first and second axial ends, the printing plate having a first end and a second end, said adjustment device comprising:

first rail means for clamping the first end of a printing plate to the plate cylinder;

means for retaining said first rail means within the groove, said means for retaining comprising means for permitting movement of said first rail means within the groove in at least an axial direction;

second rail means for clamping the second end of a printing plate to the plate cylinder, said second rail means being disposed substantially parallel to said first rail means;

means for retaining said second rail means within the groove, said means for retaining said second rail means comprising means for permitting movement of said second rail means within the groove in at least an axial direction;

adjusting means for selectively adjustably displacing said first rail means in an axial direction with respect to the plate cylinder;

means for substantially simultaneously displacing said second rail means in at least an axial direction upon said axial displacement of said first rail means; and said adjusting means further comprising:

an axial rod for being disposed within the groove of a plate cylinder substantially adjacent said first rail means;

means for mounting said axial rod within the groove of a plate cylinder;

means for axially displacing said axial rod, said means for axially displacing comprising knob means rotatable about an axis of rotation, said rotatable knob means comprising an eccentric cam surface disposed thereabout;

means for engaging said axial rod with said eccentric cam surface, and said knob means being rotatable to rotate said eccentric cam surface and axially displace said axial rod; and means for connecting said first rail means with said axial rod for axially displacing said first rail means upon axial displacement of said axial rod.

2. The device according to claim 1, wherein:

said means for substantially simultaneously displacing comprises a pivotable member pivotably mounted on the plate cylinder; and said pivotable member comprising:

a first portion for engaging with said first rail means for movement of said first portion along with movement of said first rail means;

a second portion for engaging with said second rail means for moving said second rail means upon movement of said first rail means; and a pivot disposed between said first and second portions for movement of said second rail means in a substantially opposite direction to the axial displacement of said first rail means.

3. The device according to claim 2, further including the plate cylinder having a direction of rotation, the second end of the printing plate comprising a leading edge of the printing plate in the direction of rotation of the printing plate, and the first end of the printing plate comprising a trailing edge of the printing plate in the direction of rotation of the printing plate, and wherein:

said first rail means comprises a slot;

said first portion of said pivotable member comprises a portion disposed within said slot; and said second portion of said pivotable member comprises means for engaging said second rail means.

4. The device according to claim 3, wherein:

said pivotable member engaging both said first and second rail means comprises a sole pivotable member engaging both said first and second rail means;

said sole pivotable member engaging both said first and second rail means being disposed adjacent the first axial end of the plate cylinder;

said sole pivotable member engaging both said first and second rail means comprises an articulated lever;

said articulated lever comprises a first lever arm and a second lever arm, said second lever arm being disposed at an angle with respect to said first lever arm;

said first lever arm comprises said first portion of said pivotable member and said second lever arm comprises said second portion of said pivotable member;

said first and second lever arms having a first end at said pivot and a second end disposed away from said pivot;

said second end of said first lever arm comprises said portion disposed within said slot;

said second end of said second lever arm comprises a hinge pin; and said second rail means comprising a portion for engaging said hinge pin.

5. The device according to claim 4, wherein said pivot of said sole pivotable member engaging both said first and second rail means comprises a first pivot, and said hinge pin of said second end of said second lever arm comprises a first hinge pin, and said device further includes:

a coupling element pivotably mounted adjacent the second axial end of the plate cylinder and pivotably connecting solely said second rail means to the plate cylinder, said coupling element comprising:

a first end and a second end;

said first end of said coupling element comprises a second pivot, said second end of said coupling element being pivotable about said second pivot;

said second end of said coupling element comprises a second hinge pin;

said second rail means comprising a portion for engaging said second hinge pin; and said first and second hinge pins are disposed axially offset towards one another with respect to their corresponding one of said first and second pivots.

6. The device according to claim 5, wherein the plate cylinder has an axial length between the first and second axial ends thereof, and said means for retaining said first rail means within the groove comprising:

a first clamping rail for being disposed at the first axial end of the plate cylinder; and a second clamping rail for being disposed at the second axial end of the plate cylinder;

said first and second clamping rails being configured for radially retaining said first rail means within the groove and for permitting axial and circumferential movement of said first rail means within the groove; and said axial rod being disposed within the groove between at least a portion of said first rail means and the bottom of the groove.

7. The device according to claim 6, wherein:

said axial rod comprises first and second ends, said means for mounting comprises bearing members for mounting said first and second ends of said axial rod to sides of the groove of a plate cylinder;

said first and second rail means each comprises clamping members for clamping an end of a printing plate therein;

said means for connecting said first rail means with said axial rod comprises:

first and second disc-shaped members positionally fixed about said axial rod, said first and second disc-shaped members being spaced apart axially from one another a first distance;

a pin extending from said first rail means between said first and second disc-shaped members, said pin having a diameter;

said diameter of said pin being substantially the same as the first distance;

said adjusting means additionally comprises:

a biasing member for axially biasing said axial rod into engagement with the cam surface of said knob means;

means for mounting said knob means at the first axial end of the plate cylinder;

said knob means comprises a rotation scale for indicating the axial position of said axial rod;

said first rail means comprises first and second leg portions defining said slot therebetween, said leg portions being disposed spaced apart from one another a second distance;

said second end of said first lever arm having a width, the width of said second end being substantially the same as the second distance;

said second end of said first lever arm having a first rounded surface for engaging said first leg portion and a second rounded surface for engaging said second leg portion;

said device further comprises first and second mounting plates for mounting said second rail means withing the groove of a plate cylinder;

said first and second mounting plates for being positionally fixed within the groove of a plate cylinder adjacent a corresponding one of the first and second axial ends of the groove;

said first and second mounting plates each have a first portion for attaching said mounting plates within the groove, and a second portion disposed away from said first portion, said second portions of said mounting plates each comprising one of said first and second pivots;

said second rail means comprises a bearing plate for being disposed at the bottom of the groove of a plate cylinder, said bearing plate comprising means for receiving said first and second hinge pins therein; and said first and second hinge pins are axially offset towards one another from said first and second pivots by an angle of between about 44° to about 50°, measured from a circumferential direction.

8. A device for adjusting positioning of a printing plate mounted on a plate cylinder of a rotary printing machine, the plate cylinder having a first axial end and a second axial end, the second axial end being disposed substantially opposite to the first axial end, the printing plate having a first end and a second end, said adjustment device comprising:

first rail means for clamping the first end of a printing plate to the plate cylinder, said first rail means having a first axial end adjacent the first axial end of the plate cylinder and a second axial end adjacent the second axial end of the plate cylinder;

second rail means for clamping the second end of a printing plate to the plate cylinder, said second rail means being disposed substantially parallel to said first rail means, and said second rail means having a second axial end adjacent the first axial end of the plate cylinder and a second axial end adjacent the second axial end of the plate cylinder;

a coupling element for pivotably mounting said second axial end of said second rail means to said plate cylinder, said coupling element being disposed adjacent the second axial end of the plate cylinder, said coupling element comprising:

first connection means for solely pivotably connecting said coupling element to the plate cylinder;

second connection means for solely pivotably connecting said coupling element to said second end of said second rail means; and said first connection means and said second connection means of said coupling element comprising the sole connection means of said coupling element;

adjusting means for selectively adjustably displacing said first rail means with respect to the plate cylinder;

means for substantially simultaneously displacing said second rail means in at least an axial direction upon said displacement of said first rail means, said means for substantially simultaneously displacing comprising a pivotable member for pivotably mounting said first axial end of said second rail means to said plate cylinder, said pivotable member being pivotably mounted to the plate cylinder adjacent said first axial end of said plate cylinder;

said pivotable member comprising:

a first portion for engaging with said first rail means;

a second portion for engaging with said second rail means; and a pivot disposed between said first and second portions, said pivotable member being pivotable about said pivot;

said first rail means comprises a slot;

said first portion of said pivotable member comprises a portion disposed within said slot for moving said pivotable member with said slot upon movement of said first rail means; and said second portion of said pivotable member comprises means for engaging said second rail means for moving said second rail means upon movement of said first rail means.

9. The device according to claim 8, wherein:

said pivotable member engaging both said first and second rail means is a sole pivotable member engaging both said first and second rail means; and said coupling element and said pivotable member being sole means for pivotably mounting said second rail means to said plate cylinder.

10. The device according to claim 9, wherein said pivot of said pivotable member comprises a first pivot, and further including:

said sole pivotable member comprising an articulated lever, and said articulated lever comprising:

a first lever arm and a second lever arm, said second lever arm being disposed at an angle with respect to said first lever arm;

said first lever arm comprises said first portion of said pivotable member and said second lever arm comprises said second portion of said pivotable member;

said first and second lever arms having a first end at said pivot and a second end disposed away from said pivot;

said second end of said first lever arm comprises said portion disposed within said slot;

said second end of said second lever arm comprises a first hinge pin;

said second rail means comprising a portion for engaging said first hinge pin;

said coupling element comprising:

a first end and a second end;

said first end of said coupling element comprises said first connection for connecting said coupling element to said plate cylinder, said first connection comprising a second pivot, said second end of said coupling element being pivotable about said second pivot;

said second end of said coupling element comprises said second connection for connecting said second end of said second rail means to said coupling element, said second connection comprises a second hinge pin; and said second rail means comprising a portion for engaging said second hinge pin.

11. The device according to claim 10, wherein said first and second hinge pins are disposed axially offset towards one another with respect to their corresponding one of said first and second pivots.

12. The device according to claim 11, wherein the plate cylinder has an axial length between the first and second axial ends thereof, and the plate cylinder further comprises a groove disposed axially between the first and second axial ends thereof, the groove having a bottom, and said device further comprises:

means for retaining said first rail means within the groove;

said means for retaining comprising:

a first clamping rail for being disposed at the first axial end of the plate cylinder; and a second clamping rail for being disposed at the second axial end of the plate cylinder; and said first and second clamping rails being configured for radially retaining said first rail means within the groove and for permitting axial and circumferential movement of said first rail means within the groove.

13. The device according to claim 12, wherein said adjusting means further comprises:

an axial rod for being disposed within the groove between at least a portion of said first rail means and the bottom of the groove;

means for mounting said axial rod within the groove of a plate cylinder;

means for axially displacing said axial rod, said means for axially displacing comprises knob means rotatable about an axis of rotation, said rotatable knob means comprising an eccentric cam surface disposed thereabout, and said knob means being rotatable to axially displace said axial rod; and means for connecting said first rail means with said axial rod for axially displacing said first rail means upon axial displacement of said axial rod.

14. The device according to claim 13, wherein:

said axial rod comprises first and second ends, said means for mounting comprises bearing members for mounting said first and second ends of said axial rod to sides of the groove of a plate cylinder;

said first and second rail means each comprises clamping members for clamping an end of a printing plate therein;

said means for connecting said first rail means with said axial rod comprises:

first and second disc-shaped members positionally fixed about said axial rod, said first and second disc-shaped members being spaced apart axially from one another a first distance;

a pin extending from said first rail means between said first and second disc-shaped members, said pin having a diameter;

said diameter of said pin being substantially the same as the first distance;

said adjusting means additionally comprises:

a biasing member for axially biasing said axial rod into engagement with the cam surface of said knob means;

means for mounting said knob means at the first axial end of the plate cylinder;

said knob means comprises a rotation scale for indicating the axial position of said axial rod;

said first rail means comprises first and second leg portions defining said slot therebetween, said leg portions being disposed spaced apart from one another a second distance;

said second end of said first lever arm having a width, the width of said second end being substantially the same as the second distance;

said second end of said first lever arm having a first rounded surface for engaging said first leg portion and a second rounded surface for engaging said second leg portion;

said device further comprises first and second mounting plates for mounting said second rail means withing the groove of a plate cylinder;

said first and second mounting plates for being positionally fixed within the groove of a plate cylinder adjacent a corresponding one of the first and second axial ends of the groove;

said first and second mounting plates each have a first portion for attaching said mounting plates within the groove, and a second portion disposed away from said first portion, said second portions of said mounting plates each comprising one of said first and second pivots;

said second rail means comprises a bearing plate for being disposed at the bottom of the groove of a plate cylinder, said bearing plate comprising means for receiving said first and second hinge pins therein; and said first and second hinge pins are axially offset towards one another from said first and second pivots by an angle of between about 44° to about 50°, measured from a circumferential direction.

15. A plate cylinder for a printing press, said plate cylinder comprising:

a first axial end and a second axial end, said second axial end being spaced axially from said first axial end;

an axial groove disposed between said first axial end and said second axial end;

means for adjustably positioning a printing plate about said plate cylinder, the printing plate having a first end and a second end, said means for adjustably positioning being disposed in said axial groove, and said means for adjustably positioning comprising:

first rail means disposed within said axial groove for clamping the first end of a printing plate to the plate cylinder;

second rail means for clamping the second end of a printing plate to the plate cylinder, said second rail means being disposed substantially parallel to said first rail means, said second rail means having a first axial end adjacent said first axial end of said cylinder, and a second axial end adjacent said second axial end of said cylinder;

adjusting means for selectively adjustably displacing said first rail means in an axial direction with respect to the plate cylinder;

means for substantially simultaneously displacing said second rail means upon said displacement of said first rail means, said means for substantially simultaneously displacing comprising a pivotable member pivotably mounted in the groove of the plate cylinder adjacent the first axial end of the plate cylinder for guiding movement of the first axial end of said second rail means;

said pivotable member comprising a first portion, a second portion, and a first pivot disposed between said first and second portions, said first pivot for pivotably mounting said pivoting member in said groove;

said first portion comprising a circular edge portion for engaging said first rail means;

said second portion comprising a first hinge pin for engaging said second rail means;

said first rail means comprising slot means for slidably receiving said circular edge portion therein;

said second rail means comprising a portion for engaging said first hinge pin;

a coupling element pivotably mounted adjacent the second axial end of the plate cylinder for pivotably coupling the second end of said second rail means to the plate cylinder and guiding movement of the second end of said second rail means, said coupling element comprising:

a first end and a second end;

said first end of said coupling element comprises a second pivot, said second pivot for pivotably mounting said coupling element in said groove;

said second end of said coupling element being pivotable about said second pivot;

said second end of said coupling element comprises a second hinge pin;

said second rail means comprising a portion for engaging said second hinge pin; and said first and second hinge pins are disposed axially offset towards one another with respect to their corresponding one of said first and second pivots.

16. The plate cylinder according to claim 15, wherein said coupling element solely couples said second end of said second rail means to said plate cylinder, and said means for adjustably positioning comprises a sole pivotable member engaging both said first rail means and said second rail means.

17. The plate cylinder according to claim 16, wherein:

the plate cylinder has a direction of rotation, the second end of the printing plate comprising a leading edge of the printing plate in the direction of rotation of the printing plate, and the first end of the printing plate comprising a trailing edge of the printing plate in the direction of rotation of the printing plate;

said first and second portions of said pivotable member have a first end at said first pivot and a second end disposed away from said first pivot;

said second end of said first portion comprising said circular edge portion disposed within said slot of said first rail means to movably engage said pivotable member with said first rail means; and said second end of said second member comprises said first hinge pin.

18. The plate cylinder according to claim 17, wherein the groove has a bottom, and said device further comprises:

means for retaining said first rail means within the groove;

said means for retaining comprising:

a first retaining rail for being disposed at the first axial end of the plate cylinder; and a second retaining rail for being disposed at the second axial end of the plate cylinder; and said first and second retaining rails being configured for radially retaining said first rail means within the groove and for permitting axial and circumferential movement of said first rail means within the groove.

19. The plate cylinder according to claim 18, wherein said adjusting means further comprises:

an axial rod for being disposed within the groove between at least a portion of said first rail means and the bottom of the groove;

means for mounting said axial rod within the groove of a plate cylinder;

means for axially displacing said axial rod, said means for axially displacing comprises knob means rotatable about an axis of rotation, said rotatable knob means comprising an eccentric cam surface disposed thereabout, and said knob means being rotatable to axially displace said axial rod; and means for connecting said first rail means with said axial rod for axially displacing said first rail means upon axial displacement of said axial rod.

20. The plate cylinder according to claim 19, wherein:

said axial rod comprises first and second ends, said means for mounting comprises bearing members for mounting said first and second ends of said axial rod to sides of the groove of the plate cylinder;

said first and second rail means each comprises clamping members for clamping an end of a printing plate therein;

said means for connecting said first rail means with said axial rod comprises:

first and second disc-shaped members positionally fixed about said axial rod, said first and second disc-shaped members being spaced apart axially from one another a first distance;

a pin extending from said first rail means between said first and second disc-shaped members, said pin having a diameter;

said diameter of said pin being substantially the same as the first distance;

said adjusting means additionally comprises:

a biasing member for axially biasing said axial rod into engagement with the cam surface of said knob means;

means for mounting said knob means at the first axial end of the plate cylinder;

said knob means comprises a rotation scale for indicating the axial position Of said axial rod;

said first rail means comprises first and second leg portions defining said slot therebetween, said leg portions being disposed spaced apart from one another a second distance;

said second end of said first portion of said pivotable member having a width, the width of said second end being substantially the same as the second distance;

said circular edge portion of said second end of said first portion having a first rounded surface for engaging said first leg portion and a second rounded surface for engaging said second leg portion;

said device further comprises first and second mounting plates for mounting said second rail means withing the groove of a plate cylinder;

said first and second mounting plates for being positionally fixed within the groove of a plate cylinder adjacent a corresponding one of the first and second axial ends of the groove;

said first and second mounting plates each have a first portion for attaching said mounting plates within the groove, and a second portion disposed away from said first portion, said second portions of said mounting plates each comprising one of said first and second pivots;

said second rail means comprises a bearing plate for being disposed at the bottom of the groove of a plate cylinder, said bearing plate comprising means for receiving said first and second hinge pins therein; and said first and second hinge pins are axially offset towards one another from said first and second pivots by an angle of between about 44° to about 50°, measured from a circumferential direction.

* * * * *